US006468725B2

(12) United States Patent
Takamuki

(10) Patent No.: US 6,468,725 B2
(45) Date of Patent: Oct. 22, 2002

(54) PHOTOTHERMOGRAPHIC MATERIAL

(75) Inventor: Yasuhiko Takamuki, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/757,677

(22) Filed: Jan. 10, 2001

(65) Prior Publication Data

US 2001/0014433 A1 Aug. 16, 2001

(30) Foreign Application Priority Data

Jan. 12, 2000 (JP) ..... 2000-003444

(51) Int. Cl.[7] ..... G03C 1/498; G03C 1/76

(52) U.S. Cl. ..... 430/496; 430/523; 430/539; 430/619; 430/961

(58) Field of Search ..... 430/496, 619, 430/961, 523, 539

(56) References Cited

U.S. PATENT DOCUMENTS

| | | | | | |
|---|---|---|---|---|---|
| 3,893,860 | A | * | 7/1975 | Sutton et al. | 430/961 |
| 4,273,844 | A | * | 6/1981 | Kobayashi et al. | 430/961 |
| 6,261,754 | B1 | * | 7/2001 | Ishigaki et al. | 430/619 |
| 6,268,118 | B1 | * | 7/2001 | Iwasaki | 430/619 |
| 6,306,574 | B1 | * | 10/2001 | Yamada et al. | 430/619 |

* cited by examiner

*Primary Examiner*—Richard L. Schilling
(74) *Attorney, Agent, or Firm*—Bierman, Muserlian and Lucas

(57) ABSTRACT

A photothermographic material is disclosed, comprising a support having on one side of the support a light-sensitive layer containing a light-sensitive silver halide, an organic silver salt, a reducing agent and a binder, and at least one protective layer, wherein the light-sensitive layer has a silver content of 0.10 to 0.45 g/cm$^3$ and a dry thickness of 1 to 10 $\mu$m, and a total dry protective layer thickness being 3 to 20 $\mu$m.

20 Claims, No Drawings

PHOTOTHERMOGRAPHIC MATERIAL

FIELD OF THE INVENTION

The present invention relates to thermally developable photothermographic materials (hereinafter, also denoted as photothermographic materials) and in particular to photothermographic material exhibiting a higher maximum density and superior sharpness, improved in fogging under high temperature and high humidity and density unevenness in thermal processing, and an image recording method and an image forming method by the use thereof.

BACKGROUND OF THE INVENTION

There are known a number of photosensitive materials comprising a support having thereon a photosensitive layer, which forms images upon imagewise exposure. Of these, techniques of forming images through thermal development are cited as a system suitable for environmental protection and simplifying image forming means.

Thermally developable photothermographic materials are disclosed, for example, in D. Morgan and B. Shely, U.S. Pat. Nos. 3,152,904 and 3,457,075, and D. H. Klosterboer, "Thermally Processed Silver Systems" (Imaging Processes and Materials, Neblette, 8th Edition, edited by J. M. Sturge, V. Walworth, and A. Shepp, page 2, 1969), etc. Such a photothermographic material contains a reducible light-insensitive silver source (such as organic silver salts), a catalytically active amount of photocatalyst (such as silver halide) and a reducing agent, which are dispersed in a binder matrix. Such photothermographic materials are stable at ordinary temperature and forms silver upon heating, after exposure, at a relatively high temperature (e.g., 80° C. or higher) through an oxidation reduction reaction between the reducible silver source (which functions as an oxidizing agent) and the reducing agent. The oxidation reduction reaction is accelerated by catalytic action of a latent image produced by exposure. Silver formed through reaction of the reducible silver salt in exposed areas provides a black image, which contrasts with non-exposes areas, leading to image formation. Such photothermographic materials meet requirements for simplified processing and environmental protection.

In such a type photothermographic materials, acutance dyes and anti-halation dyes have been employed in the light-sensitive layer or backing layer to enhance sharpness. Specifically, in the light-sensitive layer, it was necessary to incorporate a light-insensitive organic silver salt as a silver source in a sufficient amount necessary to attain a sufficiently high maximum density. Further, to hold the light-insensitive organic silver salt and the reducing agent for the silver salt within the light-sensitive layer, a binder was needed in an amount equivalent to or more than these materials, resulting in a total dry layer thickness of 10 μm or more. Although sharpness can be further enhanced by reducing the total dry layer thickness, decreasing the total dry layer thickness to 10 μm or less with maintaining the maximum density of the light-sensitive layer results in increased fogging. It was proved that specifically when aged under high temperature and high humidity, fogging markedly increased.

There are known a system for thermally processing by bringing the protective layer into contact with a heat source such as a heated drum and a system for thermal processing by bringing the backing layer into contact with a heat source. However, when the foregoing photothermographic materials are thermally processed in these systems, it was proved that uniformity in developing density was markedly deteriorated.

SUMMARY OF THE INVENTION

Accordingly, it is an object of the present invention to provide a thermally developable photothermographic material exhibiting a higher maximum density and superior sharpness and improved in fogging under high temperature and high humidity and density unevenness in thermal processing.

It is an object of the invention to provide an image recording process and image forming process exhibiting little unevenness in density, even when bringing the protective layer and/or the backing layer into contact with a heated drum.

The above objects of the invention can be accomplished by the following constitution:

1. a photothermographic material comprising a support having on one side of the support a light-sensitive layer containing a light-sensitive silver halide, a light-insensitive organic silver salt, a reducing agent and a binder, and further thereon one or more protective layer(s), wherein the light-sensitive layer has a silver content of 0.10 to 0.45 g/cm$^3$, the total dry light-sensitive layer thickness being 1 to 10 μm and the total dry protective layer thickness being 3 to 20 μm;
2. the photothermographic material described in 1, wherein the protective layer comprises at least two layers containing different binders and each having a dried layer thickness of 1.5 to 10 μm;
3. the photothermographic material described in 1 or 2, wherein the photothermographic material has a backing layer having a dried layer thickness of 0.5 to 5 μm on the opposite side of the support to the light-sensitive layer;
4. the photothermographic material described in any one of 1 through 3, wherein at least one of the protective layer and the backing layer contains colloidal inorganic particles;
5. the photothermographic material described in any one of 1 through 4, wherein the light-insensitive organic silver salt comprises tabular particles having an aspect ratio of 3 or more and exhibiting a number-averaged needle-form ratio of 1.1 to 10.0;
6. the photothermographic material described in any one of 1 through 4, wherein the light-insensitive organic silver salt is a silver salt of a polymer containing an acid group of 5 to 95% by weight;
7. the photothermographic material described in 6, wherein the light-insensitive organic silver salt is a silver salt of a polymer represented by the following formula (1) and/or a silver salt of a polymer formed through polyaddition of a mixture of a dihydric compound containing a carboxy group and an di-isocyanate compound;

$$-(A)_a-(B)_b- \qquad \text{formula (1)}$$

wherein A represents a repeating unit derived from an ethylenically unsaturated monomer containing a carboxy group; B represents a repeating unit derived from an ethylenically unsaturated monomer except for A; a and b represent contents of A and B, respectively, a is 5 to 95% by weight and b is 5 to 95% by weight, provided that the sum of a and b is 100%;

8. the photothermographic material described in any one of 1 through 7, wherein the photothermographic material exhibits a total silver coverage of the light-sensitive silver halide and the light-insensitive organic silver salt of not more than 2.4 g/m$^2$;

9. the photothermographic material described in any one of 1 through 8, wherein the photothermographic material contains an organic solvent of 5 to 1000 mg/m$^2$;
10. an image recording method, wherein the photothermographic material described in any one of 1 through 9 is exposed by using a laser exposure apparatus, in which scanning laser light is not exposed at an angle substantially vertical to the exposed surface of the photosensitive material;
11. an image recording method, wherein the photothermographic material described in any one of 1 through 9 is exposed by using a laser exposure apparatus, in which scanning laser light is longitudinally multiple;
12. an image forming method, wherein the protective layer and/or the backing layer of the photothermographic material described in any one of 1 through 9 are brought into contact with a heat source to perform development.

The following mechanism is contemplated with respect to effects of this invention. Thus, it is supposed that fogging after storage under high temperature and high humidity, which is accelerated by decreasing the light-sensitive layer thickness is improved by increasing the protective layer thickness, employing plural kinds of binders or incorporating colloidal inorganic particles to form a stronger barrier between the light-sensitive layer and the external environment, lessening effects of humidity and leading to superior results. Further, it is supposed that with regard to unevenness in density, controls of the protective layer and backing layer result in enhanced uniformity in thermal transfer to the light-sensitive layer.

DETAILED DESCRIPTION OF THE INVENTION

One aspect of this invention concerns the silver content of the light-sensitive layer and the dry layer thickness of the light-sensitive layer or the protective layer. Thus, the total dry layer thickness of the light-sensitive layer is 1 to 10 $\mu$m, preferably 2 to 8 $\mu$m. and more preferably 3 to 6 $\mu$m. A thickness of more than 10 $\mu$m adversely affects sharpness. The dry layer thickness of the protective layer is 3 to 20 $\mu$m, and preferably 5 to 18 $\mu$m. A thickness of less than 3 $\mu$m achieves no improvement in storage stability and a thickness of more than 20 $\mu$m reduces the maximum density. To enhance the effects of this invention, the ratio of the dried protective layer thickness to the dried light-insensitive layer thickness is preferably 0.5 to 2.0.

In one preferred embodiment of this invention, the protective layer comprises at least two layers containing different binders, each having a dried layer thickness of 1.5 to 10. In this case, the lower protective layer thickness preferably is equal to or more than the upper protective layer thickness.

The protective layer preferably contains a precursor compound capable of releasing a substance upon thermal processing, which is capable of restraining fogging or enhancing storage stability before or after thermal processing. Arrangement of a protective layer having a prescribed thickness on a light-sensitive layer having a prescribed thickness can control the time between releasing upon thermal processing and diffusion to the light sensitive layer, whereby effects of the precursor compound is maximally realized. The precursor compound is preferably incorporated into a protective layer adjacent to the light-sensitive layer, within preferred developing temperature and developing time ranges. Examples of preferred precursor compounds include a compound capable of releasing an image toning agent described in U.S. Pat. No. 4,510,236; a compound capable of releasing a stabilizer described in U.S. Pat. No. 4,351,896; JP-A Nos. 7-13296, 7-49547, 7-295139, 11-316438, 2000-187299, 2000-275780 and 2000-275781; and a compound capable of releasing a polyhalo-methane compound described in Japanese Patent Application No. 11-258638. The precursor compound is incorporated preferably in an amount of 0.001 to 0.10 mol per mol of silver.

In one embodiment of this invention, the photothermographic material has a backing layer having a dried layer thickness of 0.5 to 5 $\mu$m (and more preferably 0.7 to 4.0 $\mu$m) on the side of the support opposite to the light-sensitive layer.

The dried layer thickness described above can be directly measured in such a manner that the surface of the photothermographic material is vertically cleaved and the resulting section is observed through electron microphotographs thereof.

The silver content of the light-sensitive layer refers to the coating amount of light-sensitive silver halide and an organic silver salt contained in the light-sensitive layer. Thus, the coating amount of silver halide and an organic silver salt is represented by its equivalent converted to silver, expressed in g per cm$^3$ of the dried light sensitive layer. The silver content of the light-sensitive layer is 0.10 to 0.45 g/cm$^3$, and preferably 0.15 to 0.35 g/cm$^3$. A lower silver content cannot achieve sufficient maximum density and an excessive silver content results in unevenness in processing. The silver content can be determined by dividing the total coating amount of silver halide and an organic silver salt (expressed in g/cm$^2$) by the dried layer thickness (expressed in cm).

The expression, "different binders" in this invention means binders which are different in the kind thereof or which are different in kind and contained in different amounts between the protective layers.

Binders suitable for the protective layer include, for example, natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly (vinyl pyrrolidone), casein, starch, poly(acrylic acid), poly (methyl methacrylic acid), poly(vinyl chloride), poly (methacrylic acid), copoly(styrene-maleic acid anhydride), copoly(styrene-acrylonitrile, copoly(styrene-butadiene, poly (vinyl acetal) series [e.g., poly(vinyl formal) and poly(vinyl butyral), polyester series, polyurethane series, phenoxy resins, poly(vinylidene chloride), polyepoxide series, polycarbonate series, poly(vinyl acetate) series, cellulose esters, poly(amide) series. These binders may be water-soluble, water-dispersible or water-insoluble. Of water-insoluble binders are preferred polyvinyl acetal derivatives, cellulose ester derivatives, co(styrene-butadiene)polymer and polyurethane derivatives. Of water-soluble or water-dispersible polymers, co(styrene-butadiene)polymer latex and water-dispersible polyurethane derivatives are preferred.

The foregoing binders usable in the protective layer may be employed in other component layers including the light sensitive layer and backing layer.

In one embodiment of this invention, at least one of the protective layer and the backing layer preferably contains fine colloidal inorganic particles. The colloidal inorganic particles are those which are comprised mainly of an oxide of silicon, aluminum, titanium, indium, yttrium, tin, antimony, zinc, nickel, cupper, iron, cobalt, manganese, molybdenum, niobium, zirconium, vanadium, alkali metals and alkaline earth metals. Of these, silicon oxide (colloidal silica) and antimony oxide are preferred. The fine colloidal inorganic particles used in this invention preferably have a number-average particle size of 1 to 100 nm, and more preferably 5 to 50 nm. The number-average particle size refers to the average value obtained from a one-dimensional length (i.e., the length of particles arranged in a line), divided by the number of particles, which can be determined, for example, based on the definition described in "Biryushi Handbook" (Fine Particle Handbook, published by Asakura-shoten) at pages 58–59.

The colloidal inorganic particles are preferably subjected to a surface treatment to enhance hydrophobicity. Such a treatment for the colloidal inorganic particles can be carried out, for example, using coupling agents, such as silane coupling agents and titanium coupling agents. Examples of the silane coupling agents include γ-(2-aminoethyl) aminopropyltrimethoxysilane, γ-(2-aminoethyl) aminopropylmethyldimethoxysilane, γ-methacryloaminopropyltrimethoxysilane, N-(N-vinylbenzylaminoethyl)-γ-(2-aminoethyl) aminopropyltrimethoxysilane hydrochloride, hexamethyldisilane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane. Examples of the titanium coupling agents include tetrabutyltitanate, tetraoctyltitanate, isopropyltriisostealoyl titanate, isopropyltridecybenzenesulfonyltitanate, and bis (dioctylpyrophosphate)oxyacetate titanate.

The colloidal inorganic particles are commercially available, for example, from Nissan Kagaku Kogyo Co., Ltd., including silicon oxides such as SNOWTEX C, SNOWTEX N, SNOWTEX S, SNOWTEX OL, Organosilica-sol XBA-ST, MIBK-ST, MA-ST-M, IPA-ST; and antimony oxides such as SUNCOLLID A-1510LP, A-1510N, A-1550, A-2550, A-1530ZB, A-600, FR-104, FR-204AME-130, AMT-103, and ATL-130. The colloidal inorganic particles are preferably incorporated in an amount. of 5 to 35% by weight, based on the binder contained in the protective layer. A content of less than this range achieves insufficiently intended effects and the content of more than this range results in a more brittle coating layer.

The light-insensitive organic silver salt used in the invention (hereinafter, also simply denoted as an organic silver salt) preferably comprises tabular organic silver salt particles exhibiting (i) an aspect ratio of 3 or more and/or (ii) a number-average needle-form ratio of not less than 1.1 and less than 10.0, which is measured from the direction of the major face. More preferably, the particles exhibit both (i) and (ii).

The organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes such as formaldehyde, acetaldehyde, butylaldehyde), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidinic acid and/or stearic acid are specifically preferred.

The expression "comprises tabular organic silver salt particles exhibiting an aspect ratio of 3 or more" means that at least 50% by number of the total organic silver salt particles is accounted for by tabular particles having an aspect ratio of 3 or more. The organic silver salt particles having an aspect ratio of 3 or more accounts for more preferably at least 60% by number, still more preferably at least 70% by number, and most preferably at least 80% by number. The tabular organic silver salt particle having an aspect ratio of 3 or more refers to an organic salt particle exhibiting a ratio of particle diameter to particle thickness, a so-called aspect ratio (also denoted as AR) of 3 or more, which is defined as below:

$$AR=\text{diameter } (\mu m)/\text{thickness } (\mu m)$$

wherein when an organic silver salt particle is approximated to be a rectangular parallelepiped, the diameter is the maximum edge length (also denoted as MX LNG) and the thickness is the minimum edge length (also denoted as MN LNG).

The aspect ratio of the tabular organic silver salt particles is preferably within the range of 3 to 20, and more preferably 3 to 10. In the case of an aspect ratio of less than 3, the organic salt particles easily form closest packing and in the case of the aspect ratio being excessively high, organic silver salt particles are easily superposed and dispersed in a coating layer in the form of being brought into contact with each other, easily causing light scattering and leading to deterioration in transparency of the photothermographic material.

The number-average needle-form ratio of the tabular organic silver salt particles used in this invention can be determined in the following manner. Thus, the maximum length (denoted as MX LNG) and minimum width (denoted as WIDTH) of the grain are measured for at least 1000 particles, the needle-form ratio, as defined below is determined for each particle and an average value thereof is determined for total measured particles:

$$\text{Needle-form ratio}=(\text{MX LNG})/(\text{WIDTH})$$

where the maximum length of the particle (MX LNG) refers to the maximum length of a straight line connecting two points with the particle and the minimum width of the particle (WIDTH) refers to the minimum spacing between two parallel lines which are in contact with the periphery of the particle. The needle-form ratio of the tabular organic silver salt particles is preferably not less than 1.1 and less tan 10.0, and more preferably not less than 1.1 and less than 5.0.

The organic silver salt compound can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by the controlled double jet method to form organic silver salt crystals. In this case, silver halide grains may be concurrently present. The foregoing reaction process is preferably conducted while sufficiently stirring by an appropriate stirring means so that the reaction mixture within the reaction vessel becomes uniform. The method for obtaining organic silver salt particles having a preferred form is not specifically limited but effective means are those which suitably maintain mixing at the time of forming an alkali metal salt soap of the organic acid or mixing at the time of adding silver nitrate to the soap or to optimally control the ratio of silver nitrate to the soap.

After being preliminarily dispersed optionally with a binder or surfactant in advance, the organic silver salt used in this invention is preferably pulverized using a media dispersing machine or high pressure homogenizer. The preliminary dispersion can be carried out using a commonly known anchor type or blade type stirrer, a high-speed rotary centrifugal type stirring machine (dissolver) or a high-speed rotary shearing type stirring machine (homo-mixer). Examples of the media dispersing machine include a rolling mill such as a ball mill, a planetary ball mill and a vibrating ball mil, and a media dispersing machine such as a bead mill, an atreiter and a basket mill. The high pressure homogenizer include, for example, a type colliding with the vessel wall or plug, a type in which liquid is divided to plural streams and collides with each other at a high-speed and a type which allows liquid to pass through an orifice.

Dispersion is conducted preferably in a binder content of 0.1 to 10% by weight, based on the organic silver salt. The dispersion including the preliminary dispersion is carried out preferably at a temperature of not higher than 45° C. In cases when a high pressure homogenizer is employed as a dispersing means, for example, it is operated preferably at least two times under pressure of 29.42 to 98.06 MPa. The media dispersing machine is preferably operated at a circumferential speed of 6 to 13 m/sec. The organic silver salt used in this invention is preferably monodisperse. The degree of monodispersion is preferably 1 to 30% and monodisperse particles in this range lead to the desired high density images. The degree of monodispersion is defined as below:

Degree of monodispersion=(standard deviation of particle size)/(average particle size)×100 (%).

The average particle size of organic silver salt is preferably 0.01 to 0.8 μm, and more preferably 0.05 to 0.5 μm. The particle size refers to the diameter of a circle having an area equivalent to the projected area of the particle (i.e., circular equivalent diameter).

In this invention, a silver salt of a polymer containing an acid group of 5 to 95% by weight is preferably employed as an organic silver salt, thereby enhancing the intended effects of this invention. The polymer containing an acid group of 5 to 95% by weight refers to a polymer having a repeating unit containing a carboxylic acid, sulfonic acid or phosphoric acid in the form of a side chain, in an amount of 5 to 95% by weight, and an organic silver salt forming a silver salt with the acid group is more preferably employed. The polymer structure includes a polyethylene type, polyamide type, polyester type and polyurethane type. In this invention, a polymer represented by the following formula (1) is preferably employed:

—(A)a—(B)b— Formula (1)

wherein A is a repeating unit derived from an ethylenically unsaturated monomer containing a carboxy group; B is a repeating unit derived from an ethylenically unsaturated monomer except for A; a and b represent contents of A and B, respectively, a is 5 to 95% by weight and b is 5 to 95%, provided that the sum of a and b is 100%.

In the formula (1), examples of monomers represented by A include acrylic acid, methacrylic acid, itaconic acid, maleic acid, fumaric acid, citraconic acid, styrenecarboxylic acid, 2-carboxyethyl acrylate and 2-carboxyethyl methacrylate. However, the monomers are not limited to these examples. The monomers may be used alone or in combination thereof. Specifically, acrylic acid and methacrylic acid are preferred.

Preferred monomers represented by B include acrylic acid ester type monomers, methacrylic acid type monomers, styrenes and halogenated vinyls. Examples of the acrylic acid esters include methyl methacrylate, ethyl methacrylate, n-butyl acrylate, t-butyl acrylate, cyclohexyl acrylate, 2-ethylhexyl acrylate, isononyl acrylate, benzyl acrylate and phenyl acrylate. Examples of the methacrylic acid esters include methyl methacrylate, ethyl methacrylate, n-butyl methacrylate, t-butyl methacrylate, cylohexyl methacrylate, isononyl methacrylate, benzyl methacrylate, and phenyl methacrylate. Examples of the styrenes include styrene, o-methylstyrene, m-methylstyrene, p-methylstyrene, α-methylstyrene, p-tert-butylstyrene, and p-chlorostyrene. Examples of the halogenated vinyls include vinyl chloride and vinylidene chloride, but are not limited to these. These monomers mat be used alone or in combination thereof. Of the monomer described above, methyl methacrylate, t-butyl methacrylate, and styrene are preferred, and methyl methacrylate is more preferred.

Further, it is preferred that a monomer having two or more ethylenically unsaturated group and capable of cross-linking is contained as a part of the B component (herein, also denoted as C component). Examples of such a monomer having two or more ethylenically unsaturated group and capable of cross-linking include divinylbenzene, 4,4'-isopropylidene diphenylene diacrylate, 1,3-butylene diacrylate, 1,3-butylene dimethacrylate, 1,4-cyclohexylene dimethylene dimethacrylate, dimethylene glycol dimethacrylate, diisopropylidene glycol dimethacrylate, divinyl oxymethane, ethylene glycol dimethacrylate, ethylidene diacrylate, ethylidene dimethacrylate, 1,6-diacrylamidohexane, N,N'-methylene-bis-acrylamide, N,N'-(1,2-dihydroxy)methylene-bis-acrylamide, 2,2'-dimethyl-1,3-trimethylene dimethacrylate, phenylethylene dimethacrylate, tetraethylene glycol methacrylate, tetramethylene diacrylate, tetramethylene dimethacrylate, 2,2,2-trichloroethylidene dimethacrylate, triethylene glycol diacrylate, pentaerythritol triacrylate, trimethylolpropane triacrylate, tetramethylolmethane tetracrylate, triethylene glycol dimethacrylate, 1,3,5-triacryloylhexane-s-triazine, bisacrylamidoacetic acid, ethylidene trimethacrylate, propylidine triacrylate, and vinyl acryloxyacetate. These monomers may be used alone or in combination thereof. Of these monomers, ethylene glycol dimethacrylate, divinylbenzene and N,N'-methylene-bis-acrylamide are preferred, and ethylene glycol dimethacrylate is more preferred. In the formula (1), the content "a" is preferably 10 to 80% by weight, and more preferably 15 to 60% by weight;the content "b" is preferably 20 to 90% by eight, and more preferably 40 to 85% by weight. The content of the C component as a part of the B component is preferably 1 to 20% by weight, and more preferably 3 to 15% by weight.

There are also preferably employed a polymer which is formed through polyaddition of a carboxy group-containing dihydric compound and a diisocyanate compound. Such a polymer is one kind of polyurethane polymers, which is characterized in containing a carboxy group. Examples of the carboxy group-containing dihydric compound include 2,2-bis(hydroxymethyl)propionic acid, 2,2-bis(hydroxyethyl)-butanic acid, 2,2-bis(hydroxyethyl) propionic acid, 2,2-bis(hydroxyethyl)butanoic acid, 2,2-bis(hydroxypropyl)propionic acid and 2,2-bis(hydroxypropyl) butanoic acid. Examples of the diisocyanate compound include 4,4'-diphenylmethane diisocyanate, tolylene diisocyanate, hexamethylene diisocyanate, and isophorone diisocyanate. The content of the carboxy group-containing dihydric compound is preferably 10 to 60% by weight, and more preferably 20 to 50% by weight. In addition to the foregoing components, polyhydric compound such as ethylene glycol, triethylene glycol, diethylene glycol, pentaerythritol, and sorbitol may be added. In this case, the polyhydric compound is contained preferably in an amount of 1 to 30% by weight, and more preferably 5 to 20% by weight.

Exemplary examples of the polymers represented by formula (1) and polymers formed through polyaddition of a carboxy group-containing dihydric compound and a diisocyanate compound are shown below, but are not limited to these examples (in which numerals represent % by weight).

P-1 methacrylic acid/styrene copolymer (30/70)

P-2 methacrylic acid/t-butyl acrylate (40/60)

P-3 methacrylic acid/hexyl acrylate (50/50)

P-4 methacrylic acid/2-ethylhexyl acrylate copolymer (40/60)

P-5 methacrylic acid/phenyl acrylate copolymer (40/60)

P-6 methacrylic acid/cyclohexyl acrylate copolymer (40/60)

P-7 methacrylic acid/methyl methacrylate copolymer (20/80)

P-8 methacrylic acid/methyl methacrylate copolymer (30/70)

P-9 methacrylic acid/butyl methacrylate/cyclohexyl acrylate copolymer (40/20/40)

P-10 methacrylic acid/2-ethylhexyl methacrylate copolymer (40/60)

P-11 acrylic acid/styrene copolymer (20/80)

P-12 acrylic acid/hexyl acrylate (40/60)

P-13 acrylic acid/isononyl acrylate copolymer (40/60)

P-14 acrylic acid/2-ethylhexyl acrylate copolymer (60/40)

P-15 acrylic acid/phenyl acrylate copolymer (50/50)

P-16 itaconic acid/styrene copolymer (40/60)

P-17 itaconic acid/2-ethylhexyl acrylate copolymer (40/60)

P-18 itaconic acid/benzyl acrylate copolymer (40/60)

P-19 maleic acid/styrene copolymer (40/60)

P-20 maleic acid/hexyl acrylate copolymer (20/80)

P-21 maleic acid/phenyl acrylate copolymer (40/60)

P-22 methacrylic acid/methyl methacrylate/ethylene glycol dimethacrylate copolymer (40/50/10)

P-23 methacrylic acid/n-butyl acrylate/ethylene glycol dimethacrylate copolymer (30/60/10)

P-24 acrylic acid/methyl methacrylate/ethylene glycol dimethacrylate copolymer (30/60/10)

P-25 acrylic acid/methyl methacrylate/n-butyl acrylate/divinylbenzene copolymer (40/20/35/5)

P-26 acrylic acid/ethyl acrylate/methylene bis-acrylamide copolymer (40/55/5)

P-27 2,2-bis(hydroxymethyl)propionic acid/4,4'-diphenyl-Methane diisocyanate polycondensate (50/50)

P-28 2,2-bis(hydroxymethyl)butanoic acid/tolylene Diisocyanate polycondensate (50/50)

P-29 2,2-bis(hydroxymethyl9propionic acid/4,4'-diphenyl-methane diisocyanate/hexamethylene diisocynate/triethylene glycol (40/35/10/15)

Among polymers described above, polyethylene type polymers can be obtained by the commonly known emulsion polymerization method. The emulsion polymerization method is detailed in S. Hirai "Chemistry of Polymer Latex" published by Kobunshi Kankokai (1970). The polyurethane type polymers can also be obtained by referring to the methods described in Gunter Oertel, Polyurethane Handbook 21, 1985; and S. Murahashi et al, Synthetic Polymer V at page 309–359.

The polymer used for the polymeric silver salts used in the invention is preferably a weight-averaged molecular weight of 1,000 to 100,000, and more preferably 3,000 to 50,000. The polymeric silver salts can be obtained by mixing an aqueous solution of the polymer described above and aqueous silver nitrate solution. The preparation and dispersion thereof can be conducted in a manner similar to the above-described tabular organic silver salt particles having an aspect ratio of 3 or more.

Light-sensitive silver halide emulsion grains can be prepared according to the commonly known method in the photographic art, including a single jet process and double jet process, or ammoniacal precipitation, neutral precipitation and acid precipitation. The light-sensitive silver halide grains prepared in advance and then the emulsion is mixed with other components of the invention to be incorporated into the composition used in the invention. To sufficiently bring the photosensitive silver halide into contact with an organic silver salt, there can be applied such techniques that polymers other than gelatin, such as polyvinyl acetal are employed as a protective colloid in the formation of photosensitive silver halide, as described in U.S. Pat. Nos. 3,706,564, 3,706,565, 3,713,833 and 3,748,143, British Patent 1,362,970; gelatin contained in a photosensitive silver halide emulsion is degraded with an enzyme, as described in British Patent 1,354,186; or photosensitive silver halide grains are prepared in the presence of a surfactant to save the use of a protective polymer, as described in U.S. Pat. No. 4,076,539.

Silver halide grains of photosensitive silver halide in the present invention work as a light sensor. In order to minimize cloudiness after image formation and to obtain excellent image quality, the less the average grain size, the more preferred, and the average grain size is preferably less than 0.1 $\mu$m, more preferably between 0.01 and 0.1 $\mu$m, and still more preferably between 0.02 and 0.08 $\mu$m. The shape of light-sensitive silver halide grains used in this invention is not specifically limited, including regular crystal grains such as cubic or octahedral grains and non-regular crystal grains such as spherical grains, needle-like grains and tabular grains. The halide composition of silver halide grains is not specifically limited, including silver chloride, silver chlorobromide, silver iodochlorobromide, silver bromide, silver iodobromide and silver iodide. Of these, silver iodobromide is preferred.

In the photothermographic material according to this invention, a total silver coverage of light-sensitive silver halide and light-insensitive organic silver salt is preferably 0.5 to 2.4 g/m$^2$, and more preferably 1.0 to 2.2 g/m$^2$. The content of silver halide is preferably not more than 50% by weight, more preferably not more than 25% by weight, and still more preferably 0.1 to 15% by weight, based on the total silver coverage. The total silver coverage depends of the purpose for use and the using condition but adjustment of the total silver coverage to the foregoing range leads to photothermographic materials exhibiting superior sensitivity, reduced fogging and improved storage stability.

The thus prepared light-sensitive silver halide emulsion can be chemically sensitized using, for example, sulfur-containing compounds, gold compounds, platinum compounds, paradium compounds, silver compounds, tin compounds, chromium compounds and the combination thereof. The method or procedure of chemical sensitization is described in U.S. Pat. No. 4,036,650, British patent No. 1,518,850, and JP-A Nos. 51-22430, 51-78319 and 51-81124. In cases where a part of an organic silver salt is converted to light-sensitive silver halide by adding a silver halide-forming component, a low molecular weight amide compound may concurrently exist to achieve enhanced sensitization.

The light-sensitive silver halide used in this invention preferably occludes ions of metals belonging to Groups 6 to 11 of the Periodic Table. Preferred as the metals are Rh, Ru, Re, Rh, Ir, Os and Fe to improve intensity reciprocity law failure or adjust the gradation. These metals are preferably incorporated into silver halide in the form of a complex. To improve intensity reciprocity law failure, for example, Ir complex ions such as $IrCl_6^{2-}$ may be added.

Sensitizing dyes can be used in the photothermographic materials used in this invention. There can be employed any sensitizing dye which is capable of sensitizing silver halide grains to the desired wavelength region upon adsorption onto the silver halide grains. Examples of the sensitizing dyes include cyanine dyes, merocyanine dyes, complex cyanine dyes, complex merocyanine dyes, holopolar cyanine dyes, styryl dyes, hemi-cyanine dyes, oxonol dyes and hemi-oxonol dyes. Sensitizing dyes usable in this invention are described in Research Disclosure (hereinafter, denoted as RD) Item 17643, sect. IV-A December, 1978, page 23); ibid, Item 1831, sect. IX (August, 1979, page 437) and references cited therein. There can be advantageously selected sensitizing dyes suitable for spectral characteristics of light sources used various laser imager, scanner, image-setter and reproduction camera. As an example of spectral sensitization to the red light region, for example, compounds I-1 through I-38 described in JP-A No. 54-18726, compounds I-1 through I-35 described in JP-A No. 6-75322 and compounds I-1 through I-35 described in JP-A No. 7-287338 for a He—Ne laser light source; and Dye 1 through 20 described in JP-B No. 55-39818 (herein, the term, JP-B means a published Japanese Patent), compounds I-1 through I-37 described in JP-A No. 62-284343 and compounds I-1 through I-34 described in JP-A No. 7-287338 for a LED light source are advantageously selected. Using a variety of commonly known sensitizing dyes including cyanine, merocyanine, styryl, hemi-cyanine, oxonol, hemi-oxonol and xanthene dyes, silver halide emulsion grains can be spectrally sensitized to the wavelength region of 750 to 1400 nm. Useful cyanine dyes are those which contain a basic nucleus such as a thiazoline nucleus, an oxazoline nucleus, a pyrroline nucleus, a pyridine nucleus, an oxazole nucleus, a thiazole nucleus, selenazole nucleus and an imidazole nucleus. In addition to the basic nucleus, an acid nucleus such as a thiohydantoin nucleus, rhodanine nucleus, oxazolidinedione nucleus, thiazolidinedione nucleus, barbituric acid nucleus, thiazolinone nucleus, malononitrile nucleus and pyrazolo nucleus are also effective. Of the foregoing cyanine and merocyanine dyes, those which contain an imino group or a carboxy group are specifically effective. For example, there are employed dyes optimally selected from those which are described in U.S. Pat. Nos. 3,761,279, 3,719,495, 3,877,943; British patent Nos. 1,466,201, 1,469,117 and 1,422,057; JP-B Nos. 3-10391 and 6-52387; JP-A 5-341432, 6-194781 and 6-301141. Specifically preferred dyes are cyanine dyes having a thio-ether bond, including cyanine dyes described in JP-A Nos. 62-58239, 3-138638, 3-138642, 4-255840, 5-72659, 5-72661, 6-222491, 2-230506, 6-258757, 6-317868, 6-324425; and JP-A (Tokuhyohei) No. 7-500926. These dyes may be employed alone or in combination. For example, combined dyes are used for supersensitization. A dye having no spectral sensitizing ability or a substance having no absorption within the visible region, which exhibit supersensitization along with a spectral sensitizing dye, may be incorporated into a silver halide emulsion. Useful sensitizing dyes, combination of dyes exhibiting supersensitization and materials exhibiting supersensitization are described in RD 176, 17643, page 23, sect. IV-J, JP-B No. 49-25500, 43-4933 and JP-A 59-19032 and 59-192242. To incorporate a sensitizing dye into a silver halide emulsion, the dye may be directly dispersed in the emulsion, alternatively, the dye may be incorporated to the emulsion through solution in a solvent such as water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide. There can be also employed a technique of dissolving a dye in a volatile organic solvent, dispersing the solution in water or a hydrophilic colloidal medium and incorporating the dispersion into an emulsion, as described in U.S. Pat. No. 3,469,987; a technique of incorporating a dye into a silver halide emulsion through solution in an acid or incorporating the dye to the emulsion in the presence of an acid or base, as described in JP-b 44-23389, 44-27555 and 57-22091; a technique in which a dye is dissolved or dispersed in the presence of a surfactant to be incorporated to a silver halide emulsion, as described in U.S. Pat. No. 3,822,135; a technique in which a dye is directly dispersed in a hydrophilic colloidal medium and the dispersion is incorporated into a silver halide emulsion, as described in JP-A 53-102733 and 58-105141; a technique in which a dye is dissolved using a red-shifting compound and the solution is incorporated into a silver halide emulsion, as described in JP-A 51-74624. An ultrasonic homogenizer may be employed to dissolve a sensitizing dye. Sensitizing dyes may be added at any time during the process of emulsion preparation, for example, the process of forming silver halide emulsion grains and/or before desalting, during desalting and/or after desalting and before starting chemical ripening, as described in U.S. Pat. Nos. 2,735,766, 3,628,960, 4,183,756 and 4,225,666 and JP-A 58-184142 and 60-196749; and immediately before or during chemical ripening, or after chemical ripening and before coating, as described in JP-A 58-113920. Alternatively, a compound alone or in combination with another compound different in structure may be added separately, for example, during grain formation and during or after chemical ripening; or before, during and after chemical ripening. The compound to be added and the combination thereof may be optimally selected.

Reducing agents used in the photothermographic materials according to this invention include commonly known ones, for example, phenol derivatives, polyphenol derivatives having two or more phenol moieties, naphthol derivatives, bisnaphthol derivatives, polyhydroxybenzene derivatives, ascorbic acid derivatives, 3-pyrazolidone derivatives, pyrazoline-5-one derivatives, pyrazoline derivatives, phenylenediamine derivatives, hydroxylamine derivatives, hydroquinone monoether derivatives, hydroxamine derivatives, hydrazine derivatives, amidoxime derivatives, and N-hydroxyurea derivatives. Exemplary examples of reducing agents are described in detail in U.S. Pat. Nos. 3,615,533, 3,679,426, 3,672,904, 3,751,252, 3,782,949, 3,801,321, 3,794,488, 3,893,863, 3,887,376, 3,770,448, 3,819,382, 3,773,512, 3,839,048, 3,887,378, 4,009,039 and 4,021,240; British patent No. 1,486,148; Belgian patent Nos. 786,086; JP-A 50-36143, 50-36110, 50-116023, 50-99719, 50-140113, 51-51933, 51-23721, 52-84727; and JP-B No. 51-35851, and the reducing agent used in this invention is selected from such known reducing agents. The simplest method for selecting a reducing agent is to prepare a photothermographic material and evaluate performance of the reducing agent to confirm its advantages or disadvantages. In cases where silver salts of fatty acids are used as an organic silver salt, preferred reducing agents are polyphenol derivatives in which two or more phenols are bonded through an alkylene group or sulfur atom(s), specifically, polyphenol derivatives comprising two or more phenols in which at least two phenol nuclei are substituted, at the position adjacent to a hydroxy group, by an alkyl group (e.g., methyl, ethyl, propyl, t-butyl, cyclohexyl, etc.) or an acyl group (e.g., acetyl, propionyl, etc.) and linked through an alkylene group or sulfur. Examples thereof include polyphenol compounds such as 1,1-bis(2-hydroxy-3,5-dimethylphenyl)-3,5,5-trimethylhexane, 1,1-bis(2-hydroxy-3-t-butyl-5-methylphenyl)methane, 1,1-bis82-hydroxy-3,5-di-t-butylphenyl)methane, (2-hydroxy-3-t-butyl-5-methylphenyl)-(2-hydroxy-5-methylphenyl) methane, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrkis(2-hydroxy-3,5-dimethylphenyl)-2,4-ethylpentane, 2,2-bis(4-hydroxy-3,5-dimethylphenyl)propane, and 2,2-bis(4-hydroxy-3,5-di-t-butylphenyl)propane, described in U. S. Pat. Nos. 3,589,903 and 4,021,249; British patent No. 1,486,148; JP-A Nos. 51-51933, 5036110, 50-116023 and 52-84727, and JP-B No. 51-35727; bisnaphthol derivatives described in 3,672,904, such as 2,2-dihydroxy-1,1'-binaphthyl, 6,6'-dibromo-2,2'-dihydroxy-1,1'-binaphthyl, 6,6'-dinitro-2,2'-dihydoxy-1,17-binaphthyl, bis(2-hydroxy-1-naphthyl)methane, and 4,4'-dimethoxy-1,1'-dihydroxy-2,2'-binaphthyl; sulfonamidophenol and sulfonamidonaphthol derivatives described in U.S. Pat. No. 3,801,321, including, for example, 40benzenesulfonamidophenol, 2-benzenesulfonamidophenol, 2,6-dichloro4-benzenesulfonamidophenol and 4-benzenesulfonamidonaphthol. The content of the reducing agent, depending of the kind of organic silver salt and reducing agent, is preferably $5\times10^{-4}$ to $1\times10^{-1}$ mol/m$^2$, and more preferably $4\times10^{-3}$ to $8\times10^{-3}$ mol/m$^2$ in the photothermographic material used in this invention. The reducing agents may be used in combination thereof.

Photothermographic materials relating to this invention comprise a light-sensitive layer on at least one side of a support and a protective layer farther from the support than the light-sensitive layer. To control the amount or wavelength distribution of light transmitting through the light-sensitive layer, a filter layer may be provided on the same side or opposite to the light-sensitive layer. Further, the light-sensitive layer may contain a dye or pigment. Dyes described in JP-A 8-201959 are preferred. The light-sensitive layer may be comprised of plural layers and to adjust contrast, the arrangement may be a high speed layer/low speed layer or low speed layer/high sped layer. Various additives may be incorporated into any one of the light-sensitive layer, protective layer, and other component layer (s). In the photothermographic materials used in the invention, there may be employed adjuvants such as a surfactant, an antioxidant, a stabilizing agent, a plasticizer, a UV absorbent and a coating aid.

Image toning agents are preferably incorporated into the thermally developable photosensitive material used in the present invention. Examples of preferred image toning agents are disclosed in Research Disclosure Item 17029, including imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(l-carbamoyl-3,5-dimethylpyrazole), 1,8-(3,6-dioxaoctane)bis-(isothiuroniumtrifluoroacetate), and 2-(tribromomethylsulfonyl)benzothiazole; merocyanine dyes (for example, 3-ethyl-5-((3-etyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine. Of these image toning agents, phthalazone and phthalazine are preferred.

To restrain or accelerate development for the purpose of controlling the development, to enhance the spectral sensitive efficiency, or to enhance the reservation stability before and after the development, a mercapto compound, a disulfide compound and a thione compound can be incorporated in the photosensitive material. In cases where the mercapto compound is used in the present invention, any compound having a mercapto group can be used, but preferred compounds are represented by the following formulas, Ar—SM and Ar—S—S—Ar, wherein M represents a hydrogen atom or an alkaline metal atom, Ar represents an aromatic ring compound or a condensed aromatic ring compound having at least a nitrogen, sulfur, oxygen, selenium or tellurium. Preferable aromatic heterocyclic ring compounds include benzimidazole, naphthoimidazole, benzothiazole, naphthothiazole, benzoxazole, naphthooxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazoline. These aromatic heterocyclic ring compounds may contain a substituent selected from a halogen atom (e.g., Br and Cl), a hydroxy group, an amino group, a carboxy group, an alkyl group (e.g., alkyl group having at least a carbon atom, preferably 1 to 4 carbon atoms) and an alkoxy group (e.g., alkoxy group having at least a carbon atom, preferably 1 to 4 carbon atoms). Examples of mercapto-substituted aromatic heterocyclic ring compounds include 2-mercaptobenzimidazole, 2-mercaptobenzoxazole, 2-mercaptobenzothiazole, 2-mercapto-5-methylbenzoimidazole, 6-ethoxy-2-mercaptobenzothiazole, 2,2'-dithiobisbenzothiazole, 3-mercapto1,2,4-triazole, 4,5-diphenyl-2-imidazolethio, 2-mercaptoimidazole, 1-ethyl-2-mercaptobenzimidazole, 3-mercapto-1,2,4-triazole, 2-mercaptoquinoline, 2-mercapto-4-(3H)quinazolinone, 7-trifluoromethyl-4-quinolinethiol, 2,3,5,6-tetrachloro-4-pyridinethiol, 4-amino-6-hydroxy-2-mercapto-1,3,4-thiadiazole, 3-amino-5-mercapto1,2,4-triazole, 4-hydroxy-2-mercaptopyrimidine, 2-mercaptppyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole, but the exemplified compounds according to the present invention are not limited thereto. The content of the mercapto compound is preferably 0.001 to 0.3 mol, and more preferably 0.01 to 0.3 mol per mol of silver of the light-sensitive layer. Other antifoggants may be incorporated into the thermally developable photosensitive material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and JP-A 59-57234. Particularly preferred mercury-free antifoggants are heterocyclic compounds having at least one substituent, represented by -C(X1)(X2)(X3) (wherein X1 and X2 each represent halogen, and X3 represents hydrogen or halogen), as disclosed in U.S. Pat. Nos. 3,874,946 and 4,756,999. As examples of suitable antifoggants, employed preferably are compounds described in paragraph numbers [0030] through [0036] of JP-A No. 9-288328. Further, as another examples of suitable antifoggants, employed preferably are compounds described in paragraph numbers [0062] and [0063] of JP-A 9-90550. Furthermore, other suitable antifoggants are disclosed in U.S. Pat. No. 5,028,523, and European Patent 600,587; 605,981 and 631,176.

The light-sensitive layer of the photothermographic material relating to this invention may contain poyhydric alcohols as a plasticizer or lubricant, such as glycerin and diols described in U.S. Pat. No. 2,960,404, fatty acids and their ester described in U.S. Pat. Nos. 2,588,765 and 3,121,060, and silicone resins described in British Patent No. 955,061.

Component layers including a light-sensitive layer, protective layer and a backing layer may each contain a hardener. Examples of hardeners include isocynate compounds, epoxy compounds described in U.S. Pat. No. 4,791,042 and vinylsulfon type compounds described in JP-A 62-89048.

There may also be employed surfactants to improve coatability and antistatic properties. Any one of surfactants including anionic types, cationic types, betaine types, nonionic types and fluorine types can be employed. Exemplary examples thereof include fluorinated polymeric surfactants described in JP-A 62-170950 and U.S. Pat. No. 5,382,504, fluorinated surfactant described in JP-A 60-244945 and 63-188135, polysiloxane type surfactants described in U.S. Pat. No. 3,885,965, polyalkyleneoxides and anionic surfactants described in JP-A No. 6-301140.

In the present invention, a matting agent is preferably incorporated into the image forming layer side. In order to minimize image abrasion after thermal development, a matting agent is provided on the surface of a photosensitive material and the matting agent is preferably incorporated in an amount of 0.5 to 10 percent in weight ratio with respect to the total binder in the emulsion layer side. Materials of the matting agents employed in the present invention may be either organic substances or inorganic substances. Regarding inorganic substances, for example, those which can be employed as matting agents, are silica described in Swiss Patent No. 330,158, etc.; glass powder described in French Patent No. 1,296,995, etc.; and carbonates of alkali earth metals or cadmium, zinc, etc. described in U.K. Patent No. 1,173,181, etc. Regarding organic substances, those which can be employed as organic matting agents are starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169. The particle shape of the matting agent may be crystalline or amorphous. However, a crystalline and spherical shape is preferably employed. The particle size of the matting agent is expressed as the diameter of a sphere which has the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

$$\text{Variation coefficient}=(\text{Standard deviation of particle diameter})/(\text{average particle diameter})\times 100$$

The matting agent according to the present invention can be incorporated into any layer. In order to accomplish the object of the present invention, the matting agent is preferably incorporated into a layer other than the image forming layer, and is more preferably incorporated into the layer farthest from the support surface. Addition methods for the matting agent include those in which a matting agent is previously dispersed into a coating composition and is then coated, and prior to the completion of drying, a matting agent is sprayed onto the layer. When plural matting agents are added, both methods may be employed in combination.

In order to minimize the deformation of images after development processing, supports employed in the present invention are preferably plastic films (for example, polyethylene terephthalate, polycarbonate, polyimide, nylon, cellulose triacetate, polyethylene naphthalate). Of these, listed as preferred supports, are polyethylene terephthalate (hereinafter referred to as PET) and other plastics (hereinafter referred to as SPS) comprising styrene series polymers having a syndiotactic structure. The thickness of the support is between about 50 and about 300 $\mu$m, and is preferably between 70 and 180 $\mu$m. Furthermore, thermally processed plastic supports may be employed. As acceptable plastics, those described above are listed. The thermal processing of the support, as described herein, is that after film casting and prior to the photosensitive layer coating, these supports are heated to a temperature at least 30° C. higher than the glass transition point, preferably by not less than 35° C. and more preferably by at least 40° C.

The coating method of the photosensitive layer, protective layer and backing layer is not specifically limited. Coating can be conducted by any method known in the art, including air knife, dip-coating, bar coating, curtain coating, and slide hopper coating described in U.S. Pat. No. 2,681,294. Two or more layers can be simultaneously coated according to the method described in U.S. Pat. No. 2,761,791 and British patent No. 837,095.

Photothermographic materials used in this invention preferably contain a solvent of 5 to 1000 mg/m$^2$.

Examples of solvents include ketones such as acetone, isophorone, ethyl amyl ketone, methyl ethyl ketone, methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, and benzyl alcohol; glycols such as ethylene glycol, dimethylene glycol, triethylene glycol, propylene glycol and hexylene glycol; ether alcohols such as ethylene glycol monomethyl ether, and dimethylene glycol monomethyl ether; ethers such as ethyl ether, dioxane, and isopropyl ether; esters such as ethyl acetate, butyl acetate, amyl acetate, and isopropyl acetate; hydrocarbons such as n-pentane, n-hexane, n-heptane, cyclohexene, benzene, toluene, xylene; chlorinated compounds such as chloromethyl, chloromethylene, chloroform, and dichlorobenzene; amines such as monomethylamine, dimethylamine, triethanol amine, ethylenediamine, and triethylamine; and water, formaldehyde, dimethylformaldehyde, nitromethane, pyridine, toluidine, tetrahydrofuran and acetic acid. The solvents are not to be construed as limited to these examples. These solvents may be used alone or in combination. The solvent content in the photosensitive material can be adjusted by varying conditions such as temperature conditions in the drying stage after the coating stage. The solvent content can be determined by means of gas chromatography under conditions suitable for detecting the solvent and measured in the following manner. Thus, a photothermographic material is cut to a given size, which is to be accurately measured. This sample is finely chopped and sealed in a specified vial. After setting the vial onto a head space sampler, HP7694 (available from Hewlett-Packard Corp.) and heated to a prescribed temperature, the sample is introduced into gas chromatography. The solvent content can be determined by measuring the peak area of the intended solvent. All of the contained solvents cannot be determined by only one injection, so that measurement is made through the multi-space method by repeated injection of an identical sample. The total solvent content of a photothermographic material used in the invention is preferably 5 to 1000 mg/m$^2$, and more preferably 10 to 300 mg/m$^2$. The solvent content within the range described above leads to a thermally developable photosensitive material with low fog density as well as high sensitivity.

It is preferred to employ light-exposure means for image-recording on the photothermographic material. Thus, laser scanning exposure is preferably conducted using an Ar laser (488 nm), a He—Ne laser (633 nm), a red semiconductor laser (670 nm) or an infrared semiconductor laser (780 nm and 830 nm). A semiconductor laser may be employed in combination with a second harmonic generator. Plural laser light beams may be used to obtain the desired output. In this invention, an exposure time of $10^{-2}$ sec or less results in improvement in sensitivity, and the exposure time is preferably $10^{-9}$ to $10^{-5}$ sec.

It is also preferred to use a laser exposure apparatus, in which the scanning laser light is not exposed at an angle substantially vertical to the exposed surface of the photosensitive material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photosensitive material is scanned with laser light, the beam spot diameter on the surface of the photosensitive material is preferably not more than 200 $\mu$m, and more preferably not more than 100 $\mu$m. Thus, the less spot diameter preferably reduces the angle displaced from verticality of the laser incident angle. The lower limit of the beam spot diameter is 10 $\mu$m. The thus laser scanning exposure can reduce deterioration in image quality due to reflected light, such as occurrence of interference fringe-like unevenness.

Exposure applicable in this invention is conducted preferably using a laser scanning exposure apparatus producing longitudinally multiple scanning laser light, whereby deterioration in image quality such as occurrence of interference fringe-like unevenness is reduced, as compared to scanning laser light with a longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but usually extends to 60 nm.

Photothermographic materials used in this invention, which are stable at ordinary temperatures, are exposed and heated at a high temperature to undergo development. The photothermographic materials may be developed in any manner known in the art but are usually imagewise exposed and then heated to achieve development.

In one preferred embodiment of this invention, a protective layer and/or backing layer are brought into contact with a heat source to perform thermal development. Employed as a means for supplying heat are a system of bringing an image forming layer into contact with a heated drum, a system of bringing the side opposite the image forming layer into contact with a heated panel and a system of transporting the material through an oven via rollers. Of these, a system of bringing an image forming layer into contact with a heated drum and a system of bringing the side opposite the image forming layer into contact with a heated panel are preferred in terms of stable heat supply. The surface of the heated drum or heated panel is usually laminated with silicone rubber to enhance surface contact and thermal conductivity. The developing temperature is preferably 80 to 200° C., and more preferably 100 to 140° C. Sufficiently high image densities cannot be obtained at a developing temperature lower than 80° C. and at a developing temperature higher than 200° C., melting of the binder occurs, causing transfer onto the roller, adversely affecting not only images but also transport or the processing machine. Rapid access is preferred and the developing time is preferably 1 to 60 sec., and more preferably 5 to 30 sec. Silver images are formed upon heating through an oxidation reduction reaction between an organic silver salt (which functions as an oxidizing agent) and a reducing agent. The reaction progresses without supplying water from the outside.

EXAMPLES

The present invention will be described based on examples but embodiments of this invention are not limited to these.

Example 1

Preparation of Photographic Support

Both sides of a blue-tinted, 175 $\mu$m thick PET film having a blue density of 0.170 (which was tinted with Dye 1 and the blue density was measured by densitometer PDA-65, available from Konica Corp.) was subjected to corona discharge at 8 W/m$^2$ to prepare a photographic support:

Dye 1

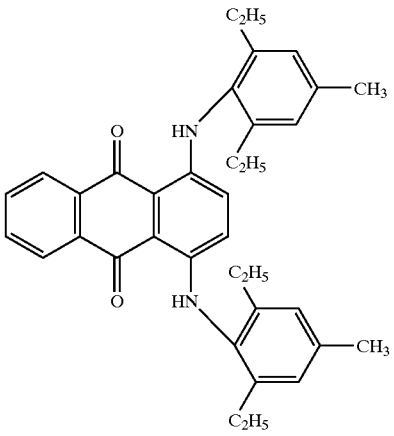

Preparation of Light-sensitive Emulsified Dispersion

According to the following procedure, a light-sensitive emulsion was prepared

Preparation of Light-sensitive Silver Halide Emulsion A

Solution A1

| | |
|---|---|
| Phenylcarbamoyl gelatin | 88.3 g |
| compound (A) (10% methanol solution) | 10 ml |
| Potassium bromide | 0.32 g |
| Water to make | 5429 ml |

Solution B1

| | |
|---|---|
| 0.67 mol/l Aqueous silver nitrate solution | 2635 ml |

Solution C1

| | |
|---|---|
| Potassium bromide | 51.55 g |
| Potassium iodide | 1.47 g |
| Water to make | 660 ml |

Solution D1

| | |
|---|---|
| Potassim bromide | 154.9 g |
| Potassium iodide | 4.41 g |
| Iridium chloride (1% solution) | 0.93 ml |
| Water to make | 1982 ml |

Solution E1

| | |
|---|---|
| 0.4 mol/l aqueous potassium bromide solution | Amount necessary to adjust silver potential |

Solution F1

| | |
|---|---|
| Potassium hydroxide | 0.71 g |
| Water to make | 20 ml |

Solution G1

| | |
|---|---|
| Aqueous 56% acetic acid solution | 18 ml |

Solution H1

| | |
|---|---|
| Anhydrous sodium carbonate | 1.72 g |
| Water to make | 151 ml |
| Compound (A) $HO(CH_2CH_2O)_n - (CH(CH_3)CH_2O)_{17} - CH_2CH_2O)_mH$ (m + n = 5 to 7) | |

Using a stirring mixer described in JP-B 58-58288 and 58-58289, ¼ of solution B1, the total amount of solution C1were added to solution A1 by the double jet addition for 4 min 45 sec. to form nucleus grain, while maintaining a temperature of 45° C. and a pAg of 8.09. After 1 min., the total amount of solution F1 was added thereto. After 6 min, ¾ of solution B1 and the total amount of solution D1 were further added by the double jet addition for 14 min 15 sec., while mainlining a temperature of 45° C. and a pAg of 8.09. After stirring for 5 min., the reaction mixture was lowered to 40° C. and solution G1 was added thereto to coagulate the resulting silver halide emulsion. Remaining 2000 ml of precipitates, the supernatant was removed and after adding 10 lit. water with stirring, the silver halide emulsion was again coagulated. Remaining 1500 ml of precipitates, the supernatant was removed and after adding 10 lit. water with stirring, the silver halide emulsion was again coagulated.

Remaining 1500 ml of precipitates, the supernatant was removed and solution H1 was added. The temperature was raised to 60° C. and stirring continued for 120 min. Finally, the pH was adjusted to 5.8 and water was added there to so that the weight per mol of silver was 1161 g, and light-sensitive silver halide emulsion A was thus obtained. It was proved that the resulting emulsion was comprised of mono-disperse silver iodobromide cubic grains having an average grain size of 0.058 μm a coefficient of variation of grain size of 12% and a [100] face ratio of 92%.

Preparation of Light-sensitive Emulsion Dispersing Solution A

Behenic acid of 217.6 g, arachidic acid of 28.2 g and stearic acid of 6.4 g were dissolved in 4720 ml of water at 90° C. Then 93.3 ml of aqueous 4 mol/l NaOH was added and the mixture was cooled to 40° C. to obtain a fatty acid sodium salt solution. To the thus obtained fatty acid sodium salt solution, 45.3 g of light-sensitive silver halide emulsion A and 450 ml of water were added and stirred for 5 min., while being maintained at 40° C. Subsequently, 702.6 ml of 1M aqueous silver nitrate solution was added in 2 min. and stirring continued further for 10 min., then, the resulting organic silver salt dispersion was introduced a washing vessel and after adding deionized water with stirring and allowing to stand, the organic silver salt dispersion was allowed to float and separated by removing lower soluble salts. Thereafter, washing with deionized water and draining were repeated until the effluent reached a conductivity of 2 μS/cm, and after subjecting to centrifugal dehydration, the reaction product was dried with heated air at 40° C. until no reduction in weight was detected to obtain powdery organic silver salt A.

In 1457 g methyl ethyl ketone was dissolved 14.57 g of polyvinyl butyral powder (Butvar B-79, available from Monsanto Corp.) and further thereto, 500 g of the powdery organic silver salt with stirring by dissolver DISPERMAT CA-40M type (available from VMA-GETZMANN Corp.) was gradually added to obtain a preliminary dispersion. Using GM-2 type, pressure-type homogenizer (available from S.T.M. Corp.), the preliminary dispersion was dispersed two times to obtain light-sensitive emulsified dispersion A. In the thus obtained dispersion A, the number-average value of the needle-form ratio was 11.5 with respect to tabular organic silver salt particles having an aspect ratio of 3 or more.

Preparation of Light-sensitive Layer Coating Solution A

Under an inert gas atmosphere, the following addenda were successively added to prepare light-sensitive layer coating solution A.

The light-sensitive emulsified dispersion A of 500 g and 100 g methyl ethyl ketone were maintained at 21° C. with stirring.

Then, 0.45 g of pyridinium hydrobromide perbromide (PHP) was added and stirred for 1 hr. and calcium bromide (3.25 ml of 10% methanol solution) was added and further stirred for 30 min. Subsequently, a mixture of an infrared sensitizing dye (7 ml of 0.1% methanol solution), 4-chloro-2benzoylbenzoic acid and supersensitizer 5-methyl-2-mercaptobenzimidazole (mixing ratio=1:250:20) was added, stirred for 1 hr., cooled to 13° C. and further stirred for 30 min.

Further, polyvinyl butyral Butvar B-79 (available from Monsanto Corp.) was added thereto in an amount shown in Table 1 and sufficiently dissolved, while maintaining the temperature at 13° C.; then, the following additives were added to prepare a coating solution A of the light-sensitive layer.

| | |
|---|---|
| Developer [1,1-bis(2-hydroxy-3,5-dimethylphenyl)-2-methylpropane] | 15 g |
| Desmodu N3300 (aliphatic isocyanate, available from Movey Corp.) | 1.10 g |
| Phthalazine | 1.5 g |
| Tetrachlorophthalic acid | 0.5 g |
| 4-Methylphthalic acid | 0.5 g |

Infrared sensitizing dye 1

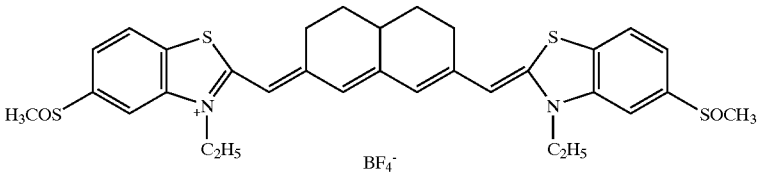

Preparation of Protective Layer Coating Solution

To 865 g of methyl ethyl ketone were added with stirring 96 g of cellulose acetate-butylate (CAB171-15, available from Eastman Chemical Co.) and 4.5 g of polymethyl methacrylate (Paraloid A-21, available from Rohm & Haas Corp.). Further thereto were added and dissolved 1.5 g of 1,3-bis(vinylsulfonyl)-2-hydroxypropane, 1.0 g of benzotriazole and 1.0 g of fluorinated surfactant (Surflon KH40, available from ASAHI Glass Co. Ltd.) to obtain a coating composition A for the surface protective layer.

Coating on the Light-sensitive Layer-side

The thus prepared light-sensitive layer coating solution A and protective layer coating solution A were simultaneously coated on the support so as to have a silver content and a dry layer thickness shown in Table 1. Drying was conducted at a temperature of 75° C. for 5 min. to obtain photothermographic material samples 1 through 5. The silver coverage was adjusted so as to be 1.5 g/m$^2$ for each sample.

Preparation of Backing Layer Coating Solution

To 830 g of methyl ethyl ketone, 84.2 g of cellulose acetate-butylate (CAB381-20, available from Eastman Chemical Co.) and 4.5 g of polyester resin (Vitel PE2200B, available from Bostic Corp.) were added with stirring and dissolved therein. To the resulting solution was added 0.30 g of infrared dye 1 and 4.5 g fluorinated surfactant (Surflon KH40, available from ASAHI Glass Co. Ltd.) and 2.3 g fluorinated surfactant (Megafag F120K, available from DAINIPPON INK Co. Ltd.) which were dissolved in 43.2 g methanol, were added thereto and stirred until being dissolved. Then, 75 g of silica (Siloid 64X6000, available from W.R. Grace Corp.), which was dispersed in methyl ethyl ketone in a concentration of 1 wt % using a dissolver type homogenizer, was further added thereto with stirring to obtain a coating solution A for backing layer.

Infrared sensitizing dye 1

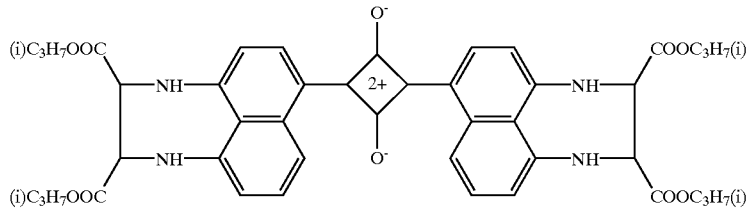

Coating of Backing Layer

The thus prepared coating solution for a backing layer was coated on the back side of each of samples 1 through 5 by an extrusion coater and dried so as to have dry thickness of 3.5 $\mu$m. Drying was carried out at a dry-bulb temperature of 100° C. and a wet-bulb temperature of 10° C. over a period of 5 min.

It was proved that the residual solvent amount was 142 mg/m$^2$ for each of samples 1 through 5.

TABLE 1

| Sample No. | Silver Content (g/cm$^3$) | Dry Layer Thickness ($\mu$m) Light-sensitive Layer | Protective Layer | Maximum Density | Sharpness | Storage Stability (ΔDmin) | Uniformity in Density | Remark |
|---|---|---|---|---|---|---|---|---|
| 1 | 0.188 | 8 | 2 | 3.0 | 0.90 | 0.050 | 1 | Comp. |
| 2 | 0.188 | 8 | 5 | 3.5 | 1.00 | 0.003 | 4 | Inv. |
| 3 | 0.300 | 5 | 8 | 3.7 | 1.00 | 0.003 | 5 | Inv. |
| 4 | 0.300 | 5 | 10 | 3.7 | 1.00 | 0.002 | 5 | Inv. |
| 5 | 0.080 | 5 | 10 | 2.1 | 0.90 | 0.010 | 2 | Comp. |
| 6 | 0.500 | 5 | 10 | 3.7 | 0.90 | 0.04 | 2 | Comp. |
| 7 | 0.500 | 5 | 20 | 3.0 | 0.09 | 0.01 | 2 | Comp. |

The thus prepared samples were evaluated according to the procedure described below with respect to maximum density, sharpness, storage stability under high temperature and high humidity and uniformity in density. Maximum density and storage stability at high temperature and high humidity.

Samples each were allowed to stand under high temperature and high humidity conditions at 50° C. and 80% RH for a period of 1 week (denoted as Condition 1) Separately, samples each were also allowed to stand under the conditions of 23° C. and 55% RH for a period of 1 week (denoted as Condition 2) . Thereafter, each of the thus aged samples was subjected to laser scanning exposure from the emulsion side using an exposure apparatus having a light source of 800 to 820 nm semiconductor laser of a longitudinal multi-mode, which was made by means of high frequency overlapping. In this case, exposure was conducted at 75° of an angle between the exposed surface and exposing laser light. Exposed samples each were subjected to thermal development at 120° C. for 15 sec., while bringing the protective layer surface of each sample into contact with the heated drum surface. Exposure and development were conducted in an atmosphere of 23° C. and 50% RH. Thermally developed samples each were subjected to densitometry, and the maximum density in condition 2 and the difference in minimum density between conditions 1 and 2 were determined.

Sharpness

A square area having a 1 cm edge of each sample was subjected to laser scanning exposure from the emulsion side using an exposure apparatus having a light source of 800 to 820 nm semiconductor laser of longitudinal multi-mode, which was made by means of high frequency overlapping. In this case, exposure was conducted at 75° of an angle between the exposed surface and exposing laser light, then, exposure giving a density of 2.5 (which is denoted as exposure x) and exposure giving a density of 0.5 (which is denoted as exposure y) were alternately conducted in which each exposed area of a 100 $\mu$m×1 cm rectangular form was arranged so that the longer edge of the exposed rectangular area was brought into contact with the longer edge of an adjacent exposed rectangular area. Each exposed area was measured with respect to maximum and minimum densities using a microdensitometer and the difference between the maximum and minimum densities, divided by 2, was defined as the sharpness. The larger value indicates superior sharpness. In cases where no deterioration in sharpness occurs, for example, the sharpness is to be 1.0.

Uniformity in Density

Photothermographic material samples were each cut to a size of 35×43 cm and subjected to laser scanning exposure from the emulsion side using an exposure apparatus having a light source of 800 to 820 nm semiconductor laser of longitudinal multi-mode, which was made by means of high frequency overlapping so that each sample was overall exposed to give a density of 1.0. In this case, exposure was conducted at 75° of an angle between the exposed surface and exposing laser light. Then, the exposed samples were each subjected to thermal development at 120° C. for 15 sec., while bringing the protective layer surface of each sample into contact with the heated drum surface. Thermal processing was conducted using Dry-pro 722 (available from Konica Corp.). An area of 1 cm$^2$ of the thus developed samples was divided into 1505 segments having an equal area, 300 segments of which were extracted and measured by a densitometer. Then, a standard deviation (σ) of density for each sample was determined and evaluated based on the following criteria, in which rank 4 or more were levels acceptable in practical use and rank 3 or less were unacceptable levels.

5: $0 \leqq \sigma < 0.01$

4: $0.01 \leqq \sigma < 0.02$

3: $0.02 \leqq \sigma < 0.03$

2: $0.03 \leqq \sigma < 0.04$

1: $0.04 \leqq \sigma$

Results obtained in the foregoing evaluation are shown in Table 1.

As can be seen from Table 1, it was shown that samples meeting the requirements regarding dry thickness of the light-sensitive layer and protective layer as claimed were exhibited a higher maximum density, superior sharpness, improved storage stability under high temperature and high humidity, and superior uniformity in density.

Example 2

Photothermographic material samples 6 through 10 were prepared according to the following manner.

Preparation of Light-sensitive Layer Coating Solution

A coating solution of the light-sensitive layer was prepared in the same manner as light-sensitive layer coating solution A in Example 1.

Preparation of Protective Layer Coating Solution A

To 665 g of methyl ethyl ketone were added with stirring 65 g of cellulose acetate-butylate (CAB171-15, available from Eastman Chemical Co.) and 3.5 g of polymethyl methacrylate (Paraloid A-21, available from Rohm & Haas Corp.). Further thereto were added and dissolved 1.5 g of 1,3-bis(vinylsulfonyl)-2-hydroxypropane, 1.0 g of benzotriazole, 1.6 g of fluorinated surfactant (Surflon KH40, available from ASAHI Glass Co. Ltd.) and 1.0 g of fluorinated surfactant (Surflon KH40, available from ASAHI Glass Co. Ltd.) to obtain a coating composition A for the lower protective layer.

Coating on the Light-sensitive Layer-side

The thus prepared light-sensitive layer coating solution A, lower protective layer coating solution A and surface protective layer coating solution A were simultaneously coated on the support used in Example 1 so as to have a silver content and a dry layer thickness shown in Table 2. Drying was conducted at a temperature of 75° C. for 5 min. to obtain photothermographic material samples 6 through 10. The silver coverage was adjusted so as to be 1.2 g/m$^2$ for each sample.

Preparation of Backing Layer Coating Solution and Coating

Backing layer coating solution A was prepared and coating thereof was conducted in the same manner as in Example 1.

It was proved that the residual solvent amount was 150 mg/m$^2$ for each of Samples 6 through 10. The thus prepared photothermographic material Samples 6 to 10 were evaluated with respect to maximum density, sharpness, storage stability under high temperature and high humidity and uniformity in density, in a manner similar to Example 1. Obtained results are shown in Table 2.

TABLE 2

| Sample No. | Sliver Content (g/cm$^3$) | Dry Layer Thickness (μm) Light-sensitive Layer | Lower Protective Layer | Surface protective Layer | Colloidal Inorganic Particle | Maximum Density | Sharpness | Storage Stability (ΔDmin) | Uniformity in Density | Remark |
|---|---|---|---|---|---|---|---|---|---|---|
| 6 | 0.15 | 8 | 1 | 1 | — | 2.7 | 0.90 | 0.050 | 1 | Comp. |
| 7 | 0.15 | 8 | 2 | 2 | — | 2.7 | 1.00 | 0.005 | 4 | Inv. |
| 8 | 0.24 | 5 | 5 | 3 | — | 3.0 | 1.00 | 0.003 | 4 | Inv. |
| 9 | 0.24 | 5 | 5 | 3 | A | 3.2 | 1.00 | 0.002 | 5 | Inv. |
| 10 | 0.24 | 5 | 5 | 3 | B | 3.2 | 1.00 | 0.002 | 5 | Inv. |

methacrylate (Paraloid A-21, available from Rohm & Haas Corp.). Further thereto were added and dissolved 4.5 g of 1,3-bis(vinylsulfonyl)-2-hydroxypropane, 3.0 g of benzotriazole and 1.6 g of silica (Siloid 320, available from Fuji Silicia Co.) to obtain a coating composition A for the surface protective layer. In Samples 9 and 10, as shown in Table 2, colloidal inorganic particles A and B relating to this invention were respectively incorporated into the surface protective layer in an amount of 30% solids by weight, based on polyvinyl butyral. The colloidal inorganic particles A and B are as follows:

Colloidal inorganic particles A: Organo Silica Sol MIBK-ST (silicon dioxide, available from NISSAN KAGAKU KOGYO Co., Ltd., particle size distribution 10 to 15 nm)

Colloidal inorganic particles B: Sun Colloid AME-130 (antimony oxide, available from NISSAN KAGAKU KOGYO Co., Ltd., particle size distribution 5 to 50 nm).

Preparation of Lower Protective Layer Coating Solution A

To 865 g of methyl ethyl ketone were added with stirring 96 g of cellulose acetate-butylate (CAB171-15, available from Eastman Chemical Co.) and 4.5 g of polymethyl methacrylate (Paraloid A-21, available from Rohm & Haas Corp.). Further thereto were added and dissolved 1.5 g of 1,3-bis(vinylsulfonyl)-2-hydroxypropane, 1.0 g of benzotriazole, 1.6 g of fluorinated surfactant (Surflon KH40, available from ASAHI Glass Co. Ltd.) and 1.0 g of fluorinated surfactant (Surflon KH40, available from ASAHI Glass Co. Ltd.) to obtain a coating composition A for the lower protective layer.

As can be seen from Table 2, samples relating to this invention exhibited not only enhanced maximum density, superior sharpness and improved storage stability under high temperature and high humidity, but also superior uniformity in density. Specifically, it was proved that Samples 9 and 10 employing colloidal inorganic particles exhibited further improved storage stability and uniformity in density.

Example 3

Photothermographic material Samples 11 through 15 were prepared according to the following manner.

Preparation of Light-sensitive Emulsion Dispersing Solution B

Behenic acid of 130.8 g, arachidic acid of 67.7 g, stearic acid of 43.6 g and palmitic acid of 2.3 g were dissolved in 4720 ml of water at 90° C. Then, 540.2 ml of aqueous 1.4 mol/l NaOH was added, and after further adding 6.9 ml of concentrated nitric acid, the mixture was cooled to 55° C. to obtain a fatty acid sodium salt solution. To the thus obtained fatty acid sodium salt solution, 45.3 g of light-sensitive silver halide emulsion A obtained in Example 1 and 450 ml of water were added and stirred for 5 min., while being maintained at 55° C. Using the thus obtained emulsion, light-sensitive emulsion dispersing solution B was obtained similarly to light-sensitive emulsion dispersing solution A. In the thus obtained dispersion B, the number-average value of the needle-form ratio was 5.4 with respect to tabular organic silver salt particles having an aspect ratio of 3 or more.

Preparation of Light-sensitive Layer Coating Solution B

Under an inert gas atmosphere, the following addenda were successively added to prepare light-sensitive layer coating solution B. Thus, the light-sensitive emulsified dispersion B of 500 g and 100 g methyl ethyl ketone were maintained at 21° C. with stirring. Then, 0.45 g of pyridinium hydrobromide perbromide (PHP) was added and stirred for 1 hr. and calcium bromide (3.25 ml of 10% methanol solution) was added and further stirred for 30 min. Subsequently, a mixture of an infrared sensitizing dye (7 ml of 0.1% methanol solution), 4-chloro-2-benzoylbenzoic acid and supersensitizer 5-methyl-2-mercaptobenzimidazole (mixing ratio=1:250:20) was added, stirred for 1 hr., cooled to 13° C. and further stirred for 30 min. Further, polyvinyl butyral Butvar B-79 (available from Monsanto Corp.) was added thereto in an amount giving a silver content and dry layer thickness, as shown in Table 3 and sufficiently dissolved, while maintaining the temperature at 13° C.; then, the following additives were added to prepare a coating solution B of the light-sensitive layer.

| | |
|---|---|
| Developer [1, 1-bis(2-hydroxy-3, 5 dimethylphenyl)-2-methylpropane] | 15 g |
| Desmodu N3300 (aliphatic isocyanate, available from Movey Corp.) | 1.10 g |
| Phthalazine | 1.5 g |
| Tetrachlorophthalic acid | 0.5 g |
| 4-Methylphthalic acid | 0.5 g |

Preparation of Protective Layer Coating Solution B

To 865 g of methyl ethyl ketone were added with stirring 96 g of cellulose acetate-butylate (CAB171-15, available from Eastman Chemical Co.) and 4.5 g of polymethyl methacrylate (Paraloid A-21, available from Rohm & Haas Corp.). Further thereto were added and dissolved 1.5 g of 1,3-bis(vinylsulfonyl)-2-hydroxypropane, 1.0 g of benzotriazole, 1.6 g of silica (Siloid 320, available from Fuji Silicia Co.) and 1.6 g of fluorinated surfactant (Surflon KH40, available from ASAHI Glass Co. Ltd.) to obtain a coating composition B for the surface protective layer. In Samples 14 and 15, as shown in Table 2, colloidal inorganic particles A and B relating to this invention were respectively incorporated into the surface protective layer in an amount of 20% solids by weight, based on cellulose acetate-butylate.

Preparation of Lower Protective Layer Coating Solution B

To 665 g of methyl ethyl ketone were added with stirring 65 g of cellulose acetate-butylate (CAB171-15, available from Eastman Chemical Co.) and 3.5 g of polymethyl methacrylate (Paraloid A-21, available from Rohm & Haas Corp.). Further thereto were added and dissolved 4.5 g of 1,3-bis(vinylsulfonyl)-2-hydroxypropane, 3.0 g of benzotriazole and 1.6 g of silica (Siloid 320, available from Fuji Silicia Co.) to obtain a coating composition B for the lower protective layer.

Coating on the Light-sensitive Layer-side

The thus prepared light-sensitive layer coating solution A, lower protective layer coating solution A and surface protective layer coating solution A were simultaneously coated on the support used in Example 1 so as to have a silver content and a dry layer thickness shown in Table 2. Drying was conducted at a temperature of 75° C. for 5 min. to obtain photothermographic material Samples 11 through 15. The silver coverage was adjusted so as to be 1.0 g/m$^2$ for each sample.

Preparation of Backing Layer Coating Solution and Coating

Backing layer coating solution A was prepared and coating thereof was conducted in the same manner as in Example 1.

It was proved that the residual solvent amount was 138 mg/m$^2$ for each of Samples 11 through 15. The thus prepared photothermographic material Samples 11 to 15 were evaluated with respect to maximum density, sharpness, storage stability under high temperature and high humidity and uniformity in density, in a manner similar to Example 1. Obtained results are shown in Table 3.

TABLE 3

| | | Dry Layer Thickness (μm) | | | | | | | | |
|---|---|---|---|---|---|---|---|---|---|---|
| Sample No. | Sliver Content (g/cm$^3$) | Light-sensitive Layer | Lower Protective Layer | Surface protective Layer | Colloidal Inorganic Particle | Maximum Density | Sharpness | Storage Stability (ΔDmin) | Uniformity in Density | Remark |
| 11 | 0.125 | 8 | 1 | 1 | — | 3.0 | 0.90 | 0.070 | 1 | Comp. |
| 12 | 0.125 | 8 | 2 | 2 | — | 3.0 | 1.00 | 0.004 | 4 | Inv. |
| 13 | 0.125 | 5 | 3 | 2 | — | 3.4 | 1.00 | 0.002 | 4 | Inv. |
| 14 | 0.200 | 5 | 3 | 2 | A | 3.4 | 1.00 | 0.001 | 5 | Inv. |
| 15 | 0.200 | 5 | 3 | 2 | B | 3.4 | 1.00 | 0.001 | 5 | Inv. |

As can be seen from Table 3, Samples 12 through 15, in which the needle-form ratio of tabular light-insensitive organic silver salt particles was within the preferred range as afore-mentioned, were further superior in maximum density and storage stability under high temperature and high humidity, as compared to samples of Examples 2. Specifically, it was proved that Samples 14 and 15 employing colloidal inorganic particles exhibited further improved storage stability and uniformity in density.

Example 4

Preparation of Coating Solutions of the Light-sensitive Layer-side and Coating Thereof Similarly to Sample 13 in Example 3, light-sensitive layer coating solution B, lower protective layer coating solution B and surface protective layer coating solution B were each prepared and coated.

Preparation of Backing Layer Coating Solutions B and C

In 830 g of methyl ethyl ketone, 84.2 g of cellulose acetate-butylate (CAB381-20, available from Eastman Chemical Co.) and 4.5 g of polyester resin (Vitel PE2200B, available from Bostic Corp.) were dissolved with stirring. To the resulting solution was added 0.30 g of infrared dye 1 and 4.5 g fluorinated surfactant (Surflon KH40, available from ASAHI Glass Co. Ltd.) and 2.3 g fluorinated surfactant (Megafag F120K, available from DAINIPPON INK Co. Ltd.), which were dissolved in 43.2 g methanol, were added thereto and stirred until being dissolved. Then, colloidal inorganic particle A was added, with stirring, in an amount of 15% solids, based on cellulose acetate-butylate and finally, 75 g of silica (Siloid 64X6000, available from W.R. Grace Corp.), which was dispersed in methyl ethyl ketone in a concentration of 1 wt % using a dissolver type homogenizer, was further added thereto with stirring to obtain a coating solution C for backing layer. Coating solution B for backing layer was also prepared, in which the colloidal inorganic particle A was not contained.

Coating of Backing Layer

The thus prepared coating solution for a backing layer was coated on the back side of each of light-sensitive layer-coated samples and dried so as to have dry thickness of 3.0 μm to prepare Sample 16 and 17.

Similarly to Example 1, the thus prepared Samples 16 and 17 were evaluate with respect to maximum density, sharpness, storage stability under high temperature and high humidity, and uniformity in density. Thermal development was carried out by bringing the backing side into contact with a heated panel at a temperature of 125° C. for a period of 20 sec. Obtained results are shown in Table 4.

TABLE 4

| Sample No. | Dry Backing Layer Thickness (μm) | Colloidal Inorganic Particle | Maximum Density | Sharpness | Storage Stability (ΔDmin) | Uniformity in Density | Remark |
|---|---|---|---|---|---|---|---|
| 16 | 3 | — | 3.4 | 1.00 | 0.001 | 4 | Inv. |
| 17 | 3 | A | 3.4 | 1.00 | 0.001 | 5 | Inv. |

As can be seen from Table 4, Samples 16 and 17 relating to this invention exhibited a higher maximum density, superior sharpness, improved storage stability under high temperature and high humidity, and superior uniformity in density.

Example 5

Photographic material Samples 18 through 22 were prepared according to the following manner.

Preparation of Light-sensitive Emulsion-dispersing Solution C

An aqueous polymer solution or dispersion, as shown in Table 5 was weighted so as to have a solids content corresponding to 0.7000 mole acid group and made to 5000 ml with a pH of 5.9 using an aqueous 1.5 mol/l sodium hydroxide solution, concentrated nitric acid and water. Further thereto, 45.3 g of light-sensitive silver halide emulsion A prepared in Example 1 and 450 ml water were added and stirred, while being maintained at 30° C. Subsequently, 702.6 ml of 1M aqueous silver nitrate solution was added over 2 min. and stirring continued further for 10 min., then, the resulting organic silver salt dispersion was introduced into a washing vessel and after adding deionized water with stirring and allowing to stand, the organic silver salt dispersion was allowed to float and separated by removing lower soluble salts. Thereafter, washing with deionized water and draining were repeated until the effluent reached a conductivity of 2 μS/cm, and after being subjected to centrifugal dehydration, the reaction product was dried with 40° C. heated air until no reduction in weight was detected to obtain powdery organic silver salt C.

In 1457 g methyl ethyl ketone was dissolved 14.57 g of polyvinyl butyral powder (Butvar B-79, available from Monsanto Corp.) and further thereto, 500 g of the powdery organic silver salt with stirring by dissolver DISPERMAT CA-40M type (available from VMA-GETZMANN Corp.) was gradually added to obtain a preliminary dispersion. Using GM-2 type, pressure-type homogenizer (available from S.T.M. Corp.), the preliminary dispersion was dispersed twice to obtain light-sensitive emulsion dispersion C.

Preparation of Light-sensitive Layer Coating Solution B

The thus-prepared light-sensitive emulsion dispersion C of 500 g and 100 g methyl ethyl ketone were mixed, while being maintained at 21° C. with stirring. Under an inert gas atmosphere, the following addenda were successively added to prepare light-sensitive layer coating solution B. Then, 0.45 g of pyridinium hydrobromide perbromide (PHP) was added and stirred for 1 hr. and calcium bromide (3.25 ml of 10% methanol solution) was added and further stirred for another 30 min. Subsequently, a mixture of an infrared sensitizing dye 1, 4-chloro-2-benzoylbenzoic acid and supersensitizer 5-methyl-2-mercaptobenzimidazole (of a mixing ratio of 1:250:20) was added, stirred for 1 hr., cooled to 13° C. and further stirred for 30 min. Further, polyvinyl butyral Butvar B-79 (available from Monsanto Corp.) was added thereto in an amount giving a silver content and dry layer thickness, as shown in Table 5 and sufficiently dissolved, while maintaining the temperature of 13° C.; followed by addition of the following additives to prepare a coating solution C of the light-sensitive layer.

| | |
|---|---|
| Developer [1, 1-bis(2-hydroxy-3, 5-dimethylphenyl)-2-methylpropane] | 15.0 g |
| Desmodu N3300 (aliphatic isocyanate, available from Movey Corp.) | 1.10 g |
| Phthalazine | 1.5 g |
| Tetrachlorophthalic acid | 0.5 g |
| 4-Methylphthalic acid | 0.5 g |

Preparation of Protective Layer Coating Solution C

To 865 g of methyl ethyl ketone were added with stirring 96 g of cellulose acetate-butylate (CAB171-15, available from Eastman Chemical Co.) and 4.5 g of polymethyl methacrylate (Paraloid A-21, available from Rohm & Haas Corp.). Further thereto were added and dissolved 1.5 g of 1,3-bis(vinylsulfonyl)-2-hydroxypropane, 1.0 g of benzotriazole, 1.6 g of silica (Siloid 320, available from Fuji Silicia Co.) and 1.6 g of fluorinated surfactant (Surflon KH40, available from ASAHI Glass Co. Ltd.). Finally, colloidal inorganic particles shown in Table 5 were incorporated into the surface protective layer in an amount of 20% solids by weight, based on cellulose acetate-butylate.

Preparation of Lower Protective Layer Coating Solution C

To 665 g of methyl ethyl ketone were added with stirring 65 g of cellulose acetate-butylate (CAB171-15, available from Eastman Chemical Co.) and 3.5 g of polymethyl methacrylate (Paraloid A-21, available from Rohm & Haas Corp.). Further thereto were added and dissolved 4.5 g of 1,3-bis(vinylsulfonyl)-2-hydroxypropane, 3.0 g of benzotriazole and 1.6 g of silica (Siloid 320, available from Fuji Silicia Co.) to obtain coating composition C for the lower protective layer.

Coating on the Light-sensitive Layer-side

The thus prepared light-sensitive layer coating solution C, lower protective layer coating solution C and surface protective layer coating solution C were simultaneously coated on the support used in Example 1 so as to have a silver content of 0.200 g/cm$^3$, a dry light-sensitive layer thickness of 5 $\mu$m, a dry lower protective layer thickness of 3 and a dry surface protective layer thickness shown of 2 $\mu$m. Drying was conducted at a temperature of 75° C. for 5 min. to obtain photothermographic material samples.

Preparation of Backing Layer Coating Solution and Coating

A backing layer coating solution was prepared and coated similarly to Example 1.

It was proved that the residual solvent amount was 145 mg/m$^2$ for each sample. The thus prepared photothermographic material Samples 18 to 22 were evaluated with respect to maximum density, sharpness, storage stability under high temperature and high humidity and uniformity in density, in a manner similar to Example 1. Obtained results are shown in Table 5.

TABLE 5

| Sample No. | Polymer | Colloidal Inorganic Particle | Maximum Density | Sharpness | Storage Stability (ΔDmin) | Uniformity in Density | Remark |
|---|---|---|---|---|---|---|---|
| 18 | P-1 | — | 3.2 | 1.00 | 0.003 | 4 | Inv. |
| 19 | P-13 | — | 3.4 | 1.00 | 0.004 | 4 | Inv. |
| 20 | P-25 | — | 3.4 | 1.00 | 0.002 | 4 | Inv. |
| 21 | P-25 | A | 3.4 | 1.00 | 0.001 | 5 | Inv. |
| 22 | P-29 | — | 3.4 | 1.00 | 0.002 | 4 | Inv. |

As can be seen from Table 5, Samples 18 and 22 relating to this invention exhibited a higher maximum density, superior sharpness, improved storage stability under high temperature and high humidity, and superior uniformity in density.

What is claimed is:

1. A photothermographic material comprising a support having on one side of the support a light-sensitive layer containing a light-sensitive silver halide, an organic silver salt, a reducing agent and a binder, and at least one protective layer, wherein the light-sensitive layer has a silver content of 0.10 to 0.45 g/cm$^3$ and a dry thickness of 1 to 10 $\mu$m, and a total dry protective layer thickness being 3 to 20 $\mu$m.

2. The photothermographic material of claim 1, wherein the protective layer comprises at least two layers containing different binders and each having a dry thickness of 1.5 to 10 $\mu$m.

3. The photothermographic material described of claim 1, wherein the photothermographic material has a backing layer having a dry thickness of 0.5 to 5 $\mu$m on the support opposite the light-sensitive layer.

4. The photothermographic material of claim 3, wherein at least one of the protective layer and the backing layer contains colloidal inorganic particles.

5. The photothermographic material of claim 1, wherein the organic silver salt comprises particles having a number-average needle-form ratio of not less than 1.1 and less than 10.0.

6. The photothermographic material of claim 1, wherein a total silver coverage of the light-sensitive silver halide and the organic silver salt is not more than 2.4 g/m$^2$.

7. The photothermographic material of claim 1, wherein the photothermographic material has a solvent content of 5 to 1000 mg/m$^2$.

8. The photothermographic material of claim 1, wherein the dry layer thickness of the light-sensitive layer is 2 to 8 $\mu$m, the total dry protective layer thickness being 5 to 18 $\mu$m.

9. The photothermographic material of claim 1, wherein a ratio of the total dry protective layer thickness to the dry thickness of the light-sensitive layer is 0.5 to 2.0.

10. The photothermographic material of claim 8, wherein the silver content is 0.15 to 0.35 g/cm$^3$.

11. The photothermographic material of claim 10, wherein a ratio of the total dry protective layer thickness to the dry thickness of the light-sensitive layer is 0.5 to 2.0.

12. The photothermographic material of claim 4, wherein the colloidal inorganic particles are mainly comprised of an oxide of an element selected from the group consisting of silicon, aluminum, titanium, indium, yttrium, tin, antimony, zinc, nickel, cupper, iron, cobalt, manganese, molybdenum, niobium, zirconium, vanadium, alkali metals and alkaline earth metals or a mixture thereof.

13. The photothermographic material of claim 12, wherein the dry layer thickness of the light-sensitive layer is 2 to 8 $\mu$m and the total dry protective layer thickness is 5 to 18 $\mu$m, the silver content being 0.15 to 0.35 g/cm$^3$, and a ratio of the total dry protective layer thickness to the dry thickness of the light-sensitive layer being 0.5 to 2.0.

14. The photothermographic material of claim 6, wherein a total silver coverage of the light-sensitive silver halide and the organic silver salt is 0.5 to 2.4 g/m$^2$ and the light-sensitive silver halide is not more than 50% by weight, based on the total silver coverage.

15. A photothermographic material comprising a support having on one side of the support a light-sensitive layer containing a light-sensitive silver halide, an organic silver salt, a reducing agent and a binder, and at least one protective layer, wherein the light-sensitive layer has a silver content of 0.10 to 0.45 g/cm$^3$ and a dry thickness of 1 to 10 $\mu$m, and a total dry protective layer thickness being 3 to 20 $\mu$m, wherein the organic silver salt is a silver salt of a polymer containing an acid group of 5 to 95% by weight.

16. A photothermographic material comprising a support having on one side of the support a light-sensitive layer containing a light-sensitive silver halide, an organic silver salt, a reducing agent and a binder, and at least one protective layer, wherein the light-sensitive layer has a silver content of 0.10 to 0.45 g/cm$^3$ and a dry thickness of 1 to 10 $\mu$m, and a total dry protective layer thickness being 3 to 20 $\mu$m, wherein the organic silver salt is a silver salt of a polymer represented by the following formula (1) or a silver salt of a polymer formed through polyaddition of a mixture of a dihydric compound containing a carboxy group and an isocyanate compound:

$$—(A)_a—(B)_b— \qquad \text{formula (1)}$$

wherein A represents a repeating unit derived from an ethylenically unsaturated monomer containing a carboxy group; B represents a repeating unit derived from an ethylenically unsaturated monomer except for A; a and b represent contents of A and B, respectively, a is 5 to 95% by weight and b is 5 to 95% by weight, provided that the sum of a and b is 100%.

17. The photothermographic material of claim 16, wherein in formula (1), A is at least a monomer selected from the group consisting of acrylic acid, methacrylic acid, itaconic acid, maleic acid, fumaric acid, citraconic acid, styrenecarboxylic acid, 2-carboxyethyl acrylate and 2-carboxyethyl methacrylate; B is at least a monomer selected from the group consisting of acrylic acid ester type monomers, methacrylic acid type monomers, styrenes and a halogenated vinyl; a is 10 to 80% and b is 20 to 90%.

18. A photothermographic material comprising a support having on one side of the support a light-sensitive layer containing a light-sensitive silver halide, an organic silver salt, a reducing agent and a binder, and at least one protective layer, wherein the light-sensitive layer has a silver content of 0.10 to 0.45 g/cm$^3$ and a dry thickness of 1 to 10 $\mu$m, and a total dry protective layer thickness being 3 to 20 $\mu$m, wherein the protective layer comprises at least two layers containing different binders and each having a dry thickness of 1.5 to 10 $\mu$m, and wherein the protective layer comprises an upper layer and a lower layer, a dry thickness of the lower layer being equal to or more than that of the upper layer.

19. A photothermographic material comprising a support having on one side of the support a light-sensitive layer containing a light-sensitive silver halide, an organic silver salt, a reducing agent and a binder, and at least one protective layer, wherein the light-sensitive layer has a silver content of 0.10 to 0.45 g/cm$^3$ and a dry thickness of 1 to 10 $\mu$m, and a total dry protective layer thickness being 3 to 20 $\mu$m, wherein the photothermographic material has a backing layer having a dry thickness of 0.5 to 5 $\mu$m on the support opposite the light-sensitive layer, wherein at least one of the protective layer and the backing layer contains colloidal inorganic particles wherein the colloidal inorganic particles are mainly comprised of an oxide of an element selected from the group consisting of silicon, aluminum, titanium, indium, yttrium, tin, antimony, zinc, nickel, copper, iron, cobalt, manganese, molybdenum, niobium, zirconium, vanadium, alkali metals and alkaline earth metals or a mixture thereof, and wherein the colloidal inorganic particles exhibit a number-average particle size of 1 to 100 nm.

20. A photothermographic material comprising a support having on one side of the support a light-sensitive layer containing a light-sensitive silver halide, an organic silver salt, a reducing agent and a binder, and at least one protective layer, wherein the light-sensitive layer has a silver content of 0.10 to 0.45 g/cm$^3$ and a dry thickness of 1 to 10 $\mu$m, and a total dry protective layer thickness being 3 to 20 $\mu$m, wherein the photothermographic material has a backing layer having a dry thickness of 0.5 to 5 $\mu$m on the support opposite the light-sensitive layer, wherein at least one of the protective layer and the backing layer contains colloidal inorganic particles, and wherein the colloidal inorganic particles are contained in an amount of 5 to 35% by weight, based on a binder contained in the protective layer.

* * * * *